US005421238A

United States Patent [19]

Catalano

[11] Patent Number: 5,421,238

[45] Date of Patent: Jun. 6, 1995

[54] MODULAR ARMOR MOUNTING SYSTEM

[75] Inventor: Salvatore B. Catalano, Warren, Mich.

[73] Assignee: The United States of America as represented by the Secretary of the Army, Washington, D.C.

[21] Appl. No.: 96,245

[22] Filed: Jul. 26, 1993

[51] Int. Cl.[6] ..... F41H 5/013

[52] U.S. Cl. ..... 89/36.02; 89/36.08; 109/79; 109/49.5; 109/50

[58] Field of Search ..... 89/36.02, 36.08, 36.01, 89/36.07, 36.04, 36.13; 109/79, 49.5, 50; 114/14

[56] References Cited

U.S. PATENT DOCUMENTS

| | | | |
|---|---|---|---|
| H129 | 9/1986 | Hansen | 89/36.04 |
| 1,287,845 | 12/1918 | Bidwell | 89/36.08 |
| 3,086,753 | 4/1963 | Cushman | 89/36.04 |
| 3,500,773 | 3/1970 | Pfaff et al. | 89/36.02 |
| 4,167,889 | 9/1979 | Bohne et al. | 89/36.02 |
| 4,961,368 | 10/1990 | Hartmann | 89/36.02 |

FOREIGN PATENT DOCUMENTS

| | | | |
|---|---|---|---|
| 2858251 | 5/1989 | Germany | 89/36.08 |
| 579764 | 9/1976 | Switzerland | 89/36.02 |

*Primary Examiner*—Stephen M. Johnson

*Attorney, Agent, or Firm*—Peter A. Taucher; Gail S. Soderling

[57] ABSTRACT

An improved modular armor system is disclosed where at least two hooks are used to hold a modular armor construction in place on a light weight vehicle hull. The hooks may have an associated cushioning means which will help protect the vehicle and crew as well as position the armor.

1 Claim, 1 Drawing Sheet

MODULAR ARMOR MOUNTING SYSTEM

GOVERNMENT INTEREST

The invention described herein may be manufactured, used and licensed by or for the Government for governmental purposes without payment to me of any royalty.

BACKGROUND OF THE INVENTION

1. Field of the Invention

In one aspect this invention relates to the armor used on combat vehicles. In yet a further aspect this invention relates to the modular armor systems used on combat vehicles.

2. Prior Art

The modern battlefield has become a place of ever increasing lethality demanding ever increasing protection. For combat vehicles increasing protection levels implies increasing the amount of armor on the vehicle which increases the vehicle weight. However, the response time available to position a military force and its vehicles from a home base has decreased, and the ability to maintain a large standing military force in foreign lands has diminished. The present protocol is to have vehicles which can be air lifted to a remote location and the vehicles deployed from that location. Air lifting heavy armored vehicles has become increasingly difficult and in the case of the heaviest vehicles is impossible.

One solution to the present problem is to have a vehicle with a relatively light weight, strong, powerful chassis which can be easily air lifted to the desired location and the needed armor protection attached to the chassis to provide the necessary threat protection. The armor and the vehicle could be transported separately and assembled at a remote site before going into battle.

Armor applied to a vehicle chassis can be of two main types; applique armor and modular armor. Applique armor will generally be sheets of armor attached to the vehicle chassis to form an armor skin; while in a modular construction armor, housings containing a threat attenuating filler are attached to the vehicle chassis. The present invention pertains primarily to modular armor.

Modular armor is designed to take the full force of enemy projectiles leaving the vehicle intact and allowing the crew and vehicle to continue functioning until the vehicle can be brought to an safe area for repair. It is one of the strengths of modular armor that it can be repaired, modified, changed or added to the vehicle as needed.

Modular armor is generally attached to the vehicle chassis using various attachment techniques. Such techniques include hinges, studs and clamps. One example of an attachment technique useful in attaching modular armor is found in U.S. Pat. No. 4,741,244. The patent shows that panels or housings to be applied to a chassis are placed on pads welded to a vehicle hull there being generally two or more pads welded to the vehicle for each panel to be attached. The pads cooperate with complimentary threaded fasteners to mount the modular armor housings on the vehicle.

The present vehicle mounting systems are quick and efficient for mounting the housings on the vehicle. However, they have some problems. While the prior art systems are simple to construct and easy to use they are easily deformed when the modular armor reacts to a threat. The deformation of the mounting system hampers replacement of the housing to the vehicle chassis and often the mounting system must be repaired before the modular armor can be replaced.

It would be desirable to have an armor mounting system which allows easy mounting and demounting of the armor as well as being strong enough to withstand the shock of a threat incursion with out deformation without deforming the mounting system. It would also be desirable to have a mounting structure which allows the modular armor housing to have a shock attenuating means integrally formed as part of the mounting to protect the chassis and mounting bracketry.

BRIEF SUMMARY OF THE INVENTION

Briefly, a mounting system for attaching modular armor to a vehicle chassis modular armor according to this invention may include a first flange extending from the surface of the vehicle chassis to be protected. A second flange, spaced apart from the first flange and extending in a direction opposed to the first flange also extends from the vehicle chassis. A first hook is attached to and extends from the housing of the armor module, the first hook being shaped so as to engage the first flange. A second hook is attached to and extends from the armor module the second hook being shaped to engage the second flange; the space between the first and second hooks is smaller than the distance between the ends of the flanges so that the armor module is restrained from moving in two directions. Associated fastening means are used to firmly anchor the housing.

In the preferred embodiments an elastomeric or shock absorbing layer is disposed between the surface of the vehicle and the juxtaposed surface of the modular armor housing to protect the vehicle chassis. In yet a further refinement, additional elastomeric pads are associated with the hooks, the elastomeric pads serving to cushion the effect of threat incursions into the modular armor and also to restrain module movement in the third dimension.

DETAILED DESCRIPTION OF PREFERRED EMBODIMENTS

Figure 1:
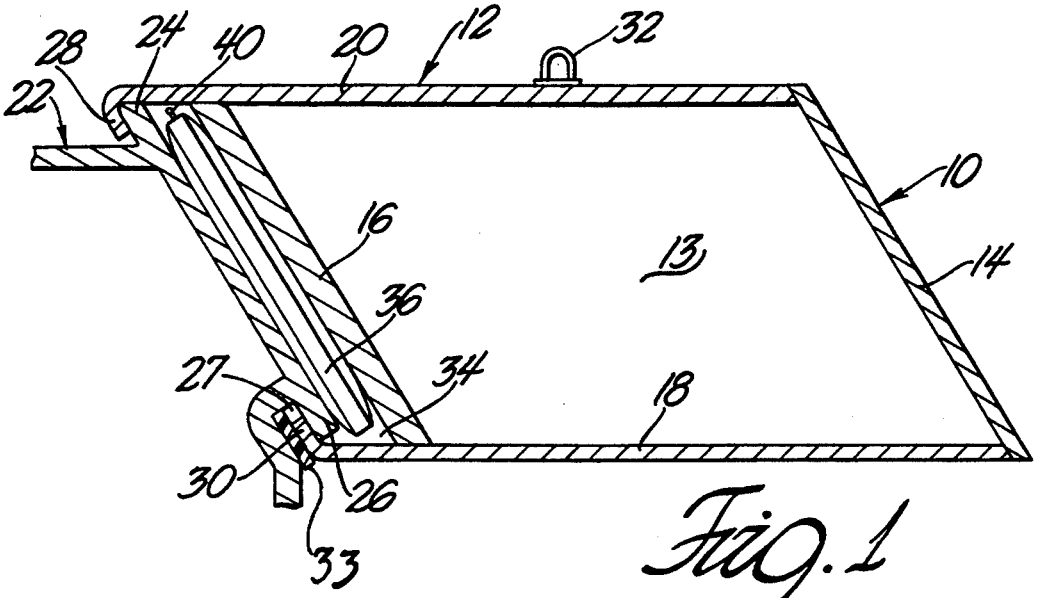
FIG. 1 is a side view in section of one embodiment of this invention with an uninflated bladder.

Referring to the accompanying drawing and initially to FIG. 1, a mounting structure is shown adapted for horizontal positioning of an armor module. The module designated generally 10 includes a housing 12 which encloses a chamber 13 filled with a threat attenuating means. The means used will depend on the perceived threats and can be adapted to various conditions. Known examples of filler materials include particulate material, reactive compounds and reactive plates. The exact type of attenuation means is not part of this invention and a further description is omitted in the interest of brevity.

The housing 12 has a front wall 14 which is the exposed surface of the housing and is adapted to receive the initial force of a threat. The housing 12 has a back wall 16 which is close to the vehicle chassis 22 only the portion of the chassis adjacent the attachment being shown. Bottom and top walls 18, 20 respectively and side walls (not shown) complete the housing structure 12.

The vehicle chassis 22 has a first flange 24 formed on the surface of the chassis the first flange extending away from the chassis to form one part of the desired attachment mechanism. The chassis 22 has a second flange 26 formed on the chassis 22. The second flange 26 is spaced apart from the vehicle chassis and extends away from the first flange 24. The two flanges 24, 26 form an attachment means for the housing 12. The second flange 26 is disposed at a distance from the chassis 12 and the adjacent portion of the chassis forming a channel 27 running parallel to the surface of the chassis. The channel 27 is bigger than the corresponding hook for reasons which will be discussed later relating to ease of installation and for protection.

The housing 12 has a first hook 28 formed to cooperate with the first flange 24. The first hook 28 extends outward from the back wall 16 and then turns back to engage the side of the first flange 24 opposite the majority of the housing. The first hook 28 is long enough that when the hook is engaging the first flange there is a cavity between the back wall 16 and the vehicle chassis 22.

The housing 12 has a second hook 30 extending from the lower portion of the housing and having a portion which is shaped and size to engage a channel 27 allowing the housing to be positioned and moved perpendicular to the plane of the drawing. An eye 32 is shown attached to the housing 12 to allow the housing to be handled using normal cranes or lifting implements to raise the housing to a level to be slid onto the chassis.

Figure 2:
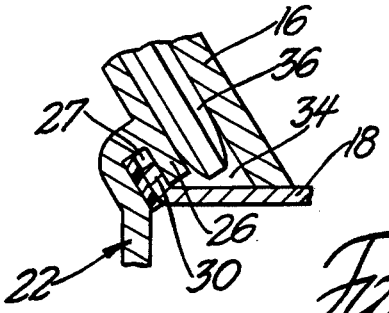
FIG. 2 is a partial view of the device of FIG. 1 with the bladder inflated.

In the embodiment shown in FIGS. 1 and 2, a cavity 34, between the vehicle chassis 22 and the back wall 16 of housing 12, contains a bladder 36 which has been inflated to occupy a major portion of the cavity 34. When the bladder 36 is uninflated, it occupies only a small portion of the cavity 34 allowing the housing to be easily slid over the flanges, the space between the free ends of the hooks being smaller than the distance between the free ends of the flanges so the housing is restrained from motion in two directions. After the housing has been positioned laterally, the bladder is inflated using a valve 40. The bladder 36 will generally be inflated to pressures on the order of 150 to 250 psi. A bladder inflated to these pressures will provide cushioning when the housing is hit by a threat and if the bladder is partially ruptured, the deflation will provide further shock attenuation. The inflated bladder will restrain motion of the housing to prevent bouncing of the housing as the vehicle moves.

Figure 3:
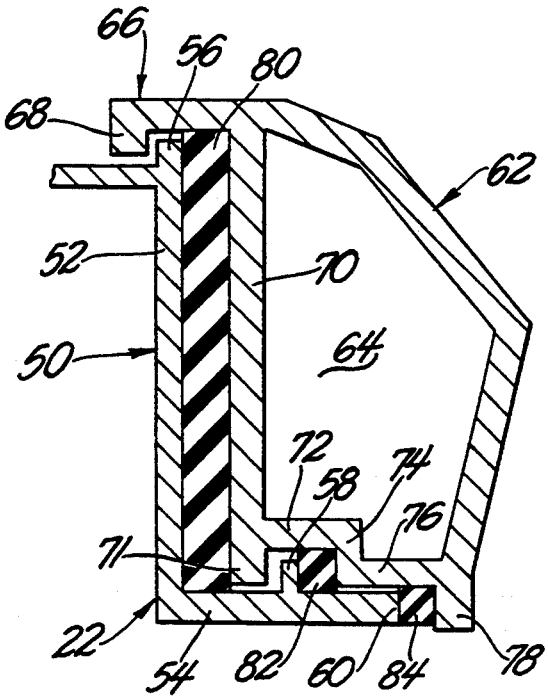
FIG. 3 is a side view in section of a second embodiment adapted for vertical positioning of an armor module.

FIG. 3 shows a second mounting structure according to this invention for attaching modular armor to a vehicle chassis 22. In this embodiment, the mounting means includes an L-shaped bracket designated generally 50, with first and second legs 52, 54, which is permanently attached to the vehicle chassis. A portion or stub of the L-shaped bracket extends beyond the vehicle chassis 22 to form a first flange 56 extending vertically from the surface of the vehicle.

The bracket 50 has a second vertically extending flange 58 located on the second leg 54 of the L-shaped bracket 50 at a midpoint of the second leg and a housing contact pad 60 is located on the free end of the L-shaped bracket's second leg 54. A modular armor housing 62 contains a cavity 64 with threat attenuating means (not shown). The housing 62 has a hook member 66 extending from its upper surface, the hook extending toward the vehicle chassis and having a vertically extending portion 68 adapted to engage the first flange 56.

A vertically extending back wall 70 of the housing 62 extends from the top of the housing and is disposed substantially parallel to the first vertically extending leg 52 of the bracket 50. A first horizontally extending wall 72 extends perpendicularly from the back wall 70 and is spaced apart from the second leg 54 so as to clear the second vertically extending flange 58. This construction provides a stub portion 71. A first vertical arm 74 extends from the bottom of the first horizontally extending wall 72 at a position removed from the back wall 70. The stub 71, first horizontally extending wall and first vertically extending arm 74 form a pocket which contains the second vertically extending flange 58. A second horizontally extending wall 76 extends from the first vertically extending arm 74 to a point beyond the free end 60 of the L-shaped bracket's second leg 54, and has a second vertically extending arm 78 attached to its end. The second horizontally extending arm 76 and second vertically extending arm 78 cooperate with the end of the L-shaped arm.

In this embodiment, the inflatable bladder described above has been replaced by a different shock attenuating material. An elongated elastomeric member 80 is located between the first leg 52 of L-shaped bracket 50 and the back wall 70 of the housing 62 to absorb a portion of a force applied to a back wall by threat incursion. A first elastomeric pad is located between the second vertically extending flange 58 and the second vertically extending arm 74 to provide a shock absorbing means preventing deformation of the second vertically extending flange when the housing is struck. A second elastomeric pad 84 disposed between the vertically extending arm 78 and the free end 60 of the L-shaped bracket 54 provides protection for the free end of the L-shaped bracket.

The elastomeric materials used in the practice of this invention can be of various foam or shock absorbing materials. Because of the environment in which the foam is used, it is desirable that the foams be resistant to flame and other battle field conditions and in addition, the foams should not burn with toxic fumes which would endanger the vehicle crew.

Various modifications and alterations will become apparent to those skilled in the art with out departing from the scope and spirit of this invention and it is understood that this invention is not limited to the illustrative embodiments set forth above.

What is claimed is:

1. A mounting structure for attaching modular armor to a vehicle chassis to be protected including an L-shaped bracket, having first and second legs permanently attached to the vehicle chassis to be protected, a portion of the first leg of the L-shaped bracket extending beyond the vehicle chassis to form a first flange extending vertically from a surface of the vehicle, the second leg extending outward from the vehicle chassis the second leg terminating at a free end, a second vertically extending flange located on the second leg of the L-shaped bracket at a midpoint of the second leg, and a housing contact pad located on the free end of the L-shaped bracket; a modular armor housing having a cavity containing a threat attenuating means, the housing having a hook member extending from its upper surface, the hook member extending toward the vehicle chassis and having a vertically extending portion adapted to engage the first flange, a vertically extending back wall being disposed substantially parallel to the first leg of the bracket, a first horizontally extending wall extending from the back wall, and spaced from the second leg so as to avoid contact with the second vertically extending flange, a first vertically extending arm extending from the horizontally extending wall at a position removed from the back wall, the back wall and first vertically extending arm forming a pocket containing the second vertically extending flange, a second horizontally extending wall extending from the first vertically extending arm to a point beyond the free end of the L-shaped bracket, and a second vertically extending arm attached to the second horizontally extending arm at a point beyond the free end of the L-shaped bracket, the second vertically extending arm cooperating with the free end of the L-shaped bracket; an elongated elastomeric member located between the L-shaped bracket and the back wall of the housing to absorb a portion of a force applied to said back wall by threat incursion, an elastomeric pad located between the second vertically extending flange and the first vertically extending arm to provide a shock absorbing means to prevent deformation of the second vertically extending flange when the housing is struck and a second elastomeric pad disposed between the second vertically extending arm and the free end of the L-shaped bracket to provide protection for the free end of the L-shaped bracket.

* * * * *